US008205466B2

(12) United States Patent
Nakajima

(10) Patent No.: US 8,205,466 B2
(45) **Date of Patent: *Jun. 26, 2012**

(54) INDOOR AND OUTDOOR UNITS OF AN AIR CONDITIONING SYSTEM CONNECTED VIA TWO WIRING CONFIGURATIONS

(75) Inventor: Seiji Nakajima, Takasaki (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 929 days.

This patent is subject to a terminal disclaimer.

(21) Appl. No.: 12/239,216

(22) Filed: Sep. 26, 2008

(65) Prior Publication Data

US 2009/0077989 A1 Mar. 26, 2009

(30) Foreign Application Priority Data

Sep. 26, 2007 (JP) ..... 2007-248464

(51) Int. Cl.

| | |
|---|---|
| ***F25D 23/12*** | (2006.01) |
| ***H02J 1/00*** | (2006.01) |
| ***H02J 3/00*** | (2006.01) |
| ***H02J 3/02*** | (2006.01) |
| ***H02J 3/34*** | (2006.01) |
| ***H04B 3/54*** | (2006.01) |
| ***H02K 1/02*** | (2006.01) |
| ***G01R 1/20*** | (2006.01) |
| ***G05D 23/00*** | (2006.01) |

(52) U.S. Cl. ..... 62/259.1; 307/1; 307/3; 307/42; 307/147; 307/154; 700/276

(58) Field of Classification Search ..... 307/1, 3, 307/42, 147, 154; 62/259.1; 700/276
See application file for complete search history.

(56) References Cited

U.S. PATENT DOCUMENTS 3,959,979 A * 6/1976 Kramer ..... 62/89
(Continued)

FOREIGN PATENT DOCUMENTS

JP 06-147616 A 5/1994
(Continued)

OTHER PUBLICATIONS

European Search Report dated Mar. 22, 2012, issued in corresponding European Patent Application No. 08016779.4 (5 pages).

*Primary Examiner* — Marc Norman
*Assistant Examiner* — Filip Zec
(74) *Attorney, Agent, or Firm* — Westerman, Hattori, Daniels & Adrian, LLP

(57) ABSTRACT

An air conditioning system including a first communication line, a second communication line, and at least one common power supply line coupling an indoor unit and an outdoor unit. The indoor unit including at least one of a first communication circuit and a second communication circuit, the first communication circuit configured to communicate through the first and second communication lines independent of the at least one power supply line, and the second communication circuit configured to communicate through the at least one power supply line and one of the first and the second communication lines. The outdoor unit including a third communication circuit with a plurality of communication terminals coupled to the indoor unit and configured to communicate with at least one of the first and second communication circuits, and a switch configured to connect one of the plurality of communication terminals of the third communication circuit to the at least one power supply line in a state where the third communication circuit is connected to the second communication circuit and configured to open a connection between the communication terminal of the third communication circuit and the at least one power supply line in a state where the third communication circuit is connected to the first communication circuit.

5 Claims, 12 Drawing Sheets

U.S. PATENT DOCUMENTS 5,457,621 A * 10/1995 Munday et al. ..... 363/21.16
5,737,168 A * 4/1998 Baker ..... 361/90
6,290,141 B1 * 9/2001 Park et al. ..... 236/51
6,392,363 B1 * 5/2002 Decker ..... 315/289
6,603,221 B1 * 8/2003 Liu ..... 307/125
6,777,954 B2 * 8/2004 Yamada et al. ..... 324/543
7,523,619 B2 * 4/2009 Kojima et al. ..... 62/132

FOREIGN PATENT DOCUMENTS

JP 06-257836 A 9/1994
JP 08-303842 11/1996

* cited by examiner

INDOOR AND OUTDOOR UNITS OF AN AIR CONDITIONING SYSTEM CONNECTED VIA TWO WIRING CONFIGURATIONS

CLAIM OF PRIORITY

The present application claims the benefit of priority, under 35 U.S.C. §119, of Japanese Patent Application No. 2007-248464 filed on Sep. 26, 2007, which is incorporated herein by reference in its entirety.

FIELD OF THE INVENTION

The present invention relates to an outdoor unit and an air conditioning system using the same.

BACKGROUND OF THE INVENTION

An air conditioning system in which an indoor unit and an outdoor unit are connected to each other and exchange information therebetween in the serial communication style is described in JP-A-08-303842.

When communication is carried out between an indoor unit and an outdoor unit as in the case of the technique described in JP-A-08-303842, two communication styles have been hitherto adopted. According to one communication style, communication is carried out by using a dedicated communication line, and according to the other communication style, communication is carried out by using a power supply line as a communication line.

Accordingly, when existing facilities adopt the former style, only indoor units and outdoor units which are adaptable to the former style can be added. Likewise, when existing facilities adopt the latter style, only indoor units and outdoor units which are adaptable to the latter style can be added. Therefore, there is a problem that the existing facilities cannot be effectively used or an optional range for indoor units and outdoor units to be added is narrowed.

SUMMARY OF THE INVENTION

An embodiment of the present invention provides an air conditioning system including a first communication line, a second communication line, and at least one common power supply line coupling an indoor unit and an outdoor unit. The indoor unit includes at least one of a first communication circuit and a second communication circuit, the first communication circuit configured to communicate through the first and second communication lines independent of the at least one power supply line, and the second communication circuit configured to communicate through the at least one power supply line and one of the first and the second communication lines. The outdoor unit includes a third communication circuit with a plurality of communication terminals coupled to the indoor unit and configured to communicate with at least one of the first and second communication circuits, and a switch configured to connect one of the plurality of communication terminals of the third communication circuit to the at least one power supply line in a state where the third communication circuit is connected to the second communication circuit and configured to open a connection between the communication terminal of the third communication circuit and the at least one power supply line in a state where the third communication circuit is connected to the first communication circuit.

BRIEF DESCRIPTION OF THE DRAWINGS

The foregoing and other features of the present invention will be more readily apparent from the following detailed description and drawings of the illustrative embodiments of the invention wherein like reference numbers refer to similar elements throughout the view and in which.

DETAILED DESCRIPTION

Figure 1A:
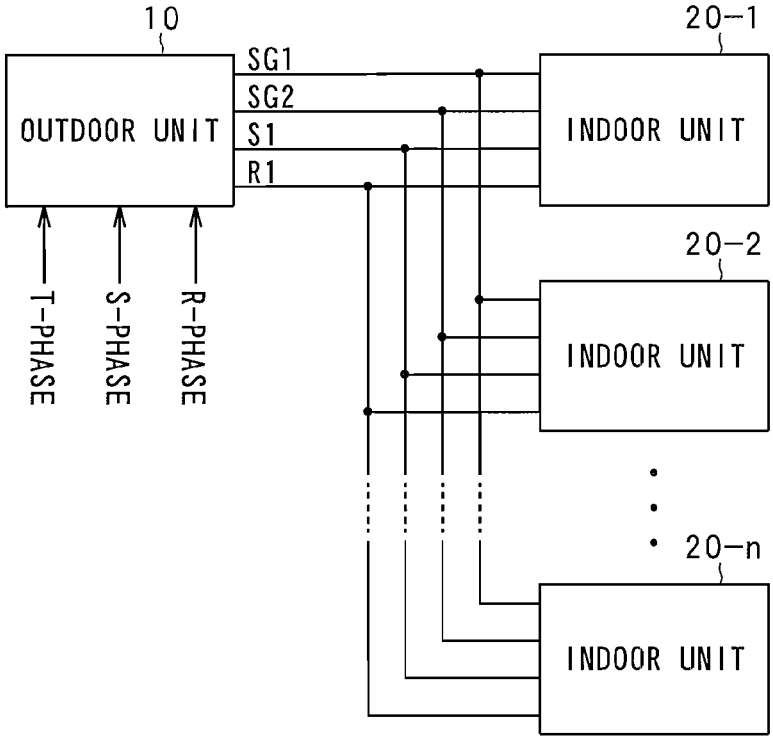
FIGS. 1A and 1B are diagrams showing the construction of an air conditioning system according to an embodiment of the present invention.

An aspect of the present invention provides an outdoor unit and an air conditioning system in which equipment can be easily added or replaced.

According to an aspect of the present invention, an air conditioning system in which an indoor unit and an outdoor unit are connected to each other through common power supply lines is characterized in that the indoor unit has at least one of a first communication circuit for performing communications through two communication lines independent of the power supply lines and a second communication circuit for performing communications through one of the power supply lines and one communication line independent of the power supply lines, and the outdoor unit has a third communication circuit that is connected to the indoor unit having at least one of the first communication circuit and the second communication circuit and communicates with one of the first communication circuit and the second communication circuit, and a switch for connecting one of communication terminals of the third communication circuit to one of the power supply lines when the third communication circuit is connected to the second communication circuit, and releasing the connection concerned when the third communication circuit is connected to the first communication circuit.

According to an embodiment of the present invention, the switching operation of the switch of the outdoor unit is controlled in accordance with whether the indoor unit has the first communication circuit or the second communication circuit, whereby the third communication circuit is connected to the first or second communication circuit. Accordingly, the switch carries out the switching operation thereof in accordance with whether the indoor unit has the first communication circuit or the second communication circuit, whereby equipment (an outdoor unit and an indoor unit) can be easily additionally provided or replaced.

In the above air conditioning system, the indoor unit has both the first communication circuit and the second communication circuit, and the switch of the outdoor unit carries out a switching operation in accordance with whether the out door unit is connected to the first communication circuit or the second communication circuit.

According to an embodiment of the present invention, the indoor unit can be connected to the outdoor unit by selecting any one of the first communication circuit and the second communication circuit provided to the indoor unit. Therefore, the indoor unit can be additionally provided or replaced irrespective of the communication system which the existing facilities adopt.

In the above air conditioning system, one of the communication terminals of the third communication circuit is a terminal connected to the ground of the third communication circuit, and the switch connects the terminal connected to the ground of the third communication circuit to one of the power supply lines.

According to an embodiment of the present invention, when the switch is set to ON-state, the ground of the third communication circuit and one of the power supply lines are connected to each other. Accordingly, the communication can be stably performed when an indoor unit executing communications by using a power supply line is connected.

In the above air conditioning system, the outdoor unit has a noise filter between a load thereof and the power supply lines, the switch connects the one of the power supply lines at the input side of the noise filter to the terminal connected to the ground of the third communication circuit, the indoor unit has a noise filter between a load thereof and the power supply lines, and the second communication circuit is connected to one of the power supply lines at the input side of the noise filter.

According to an embodiment of the present invention, the switch is connected to the input side of the noise filter in the outdoor unit, and the second communication circuit is connected to one of the power supply lines at the input side of the noise filter in the indoor unit. Accordingly, a communication signal can be prevented from being attenuated by the noise filter.

According to an aspect of the present invention, an outdoor unit that is connectable through common power supply lines to an indoor unit having at least one of a first communication circuit for performing communications through two communication lines independent of the power supply lines and a second communication circuit for performing communications through one of the power supply lines and one communication line independent of the power supply lines, is characterized in that the outdoor unit has a third communication circuit for communicating with one of the first communication circuit and the second communication circuit when the outdoor unit is connected to the indoor unit, and a switch for connecting one of communication terminals of the third communication circuit to one of the power supply lines when the third communication circuit is connected to the second communication circuit, and releasing the connection concerned when the third communication circuit is connected to the first communication circuit.

According to an embodiment of the present invention, the switching operation of the outdoor unit is controlled in accordance with whether the indoor unit has the first communication circuit or the second communication circuit, whereby the third communication circuit is connected to the first communication circuit or the second communication circuit. Accordingly, by controlling the switching operation of the switch in accordance with the condition of existing facilities, equipment(an outdoor unit and an indoor unit) can be easily additionally provided or replaced.

According to the present invention, there can be easily provided an air conditioning system and an outdoor unit with which equipment can be easily additionally provided or replaced.

Embodiments according to the present invention will be described hereunder with reference to the accompanying drawings.

(A) Construction of First Embodiment

Figure 1B:
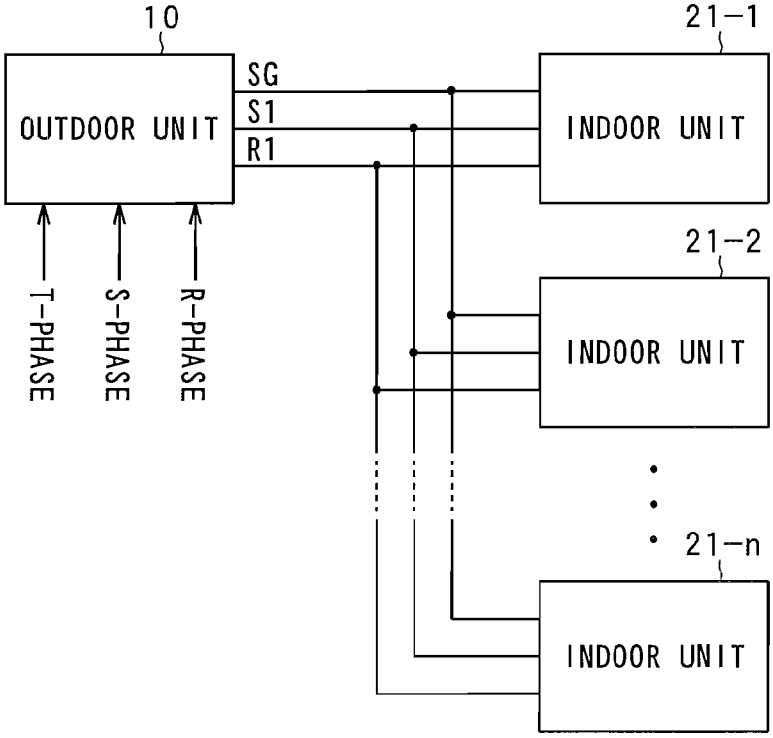

FIGS. 1A and 1B are diagrams showing the construction of a first embodiment of the present invention. FIG. 1A shows the construction when indoor units 20-1 to **20-*n* are connected to an outdoor unit 10 to perform communications by using two 10 communication lines (SG1, SG2) which are independent of power supply lines, and FIG. 1B shows an example of the construction when indoor units 21-1 to 21-*n* are connected to an outdoor unit 10 to perform communications by using one (Si) of power supply lines and one communication line (SG) independent of power supply lines. In the former case, the outdoor unit 10 and the indoor units 20-1 to 20-*n* are connected to one another through totally four connection lines, and thus this will be referred to as "4-wire type". In the latter case, the outdoor unit 10 and the indoor units 21-1 to 21-*n*** are connected to one another through totally three connection lines, and thus this will be referred to as "3-wire type".

More specifically, in FIG. 1A, the outdoor unit 10 and the indoor-units 20-1 to **20-*n* are mutually connected to one another through two communication lines SG1, SG2 and two power supply lines S1, R1. The outdoor unit 10 and the indoor units 20-1 to 20-*n* are connected to the communication lines SG1, SG2 in a bus style, and perform communications in a serial communication style. Furthermore, the power supply lines S1, R1 supplies the indoor units 20-1 to 20-*n* with S-phase and R-phase power out of three-phase AC power of R-phase, S-phase and T-phase supplied to the outdoor unit 10**.

In FIG. 1B, the outdoor unit 10 and the indoor units 21-1 to **21-*n* are mutually connected to one another through one communication line SG and two power supply lines S1, R1. A serial signal is transmitted to the communication line SG and the power supply line S1. The outdoor unit 10 and the indoor units 21-1 to 21-*n* are connected to the communication line SG and the power supply line S1 in a bus style. Furthermore, the power supply lines S1, R1 supply the indoor units 21-1 to 21-*n* with S-phase and R-phase power out of three-phase AC power of R-phase, S-phase and T-phase supplied to the outdoor unit 10**.

Figure 2:
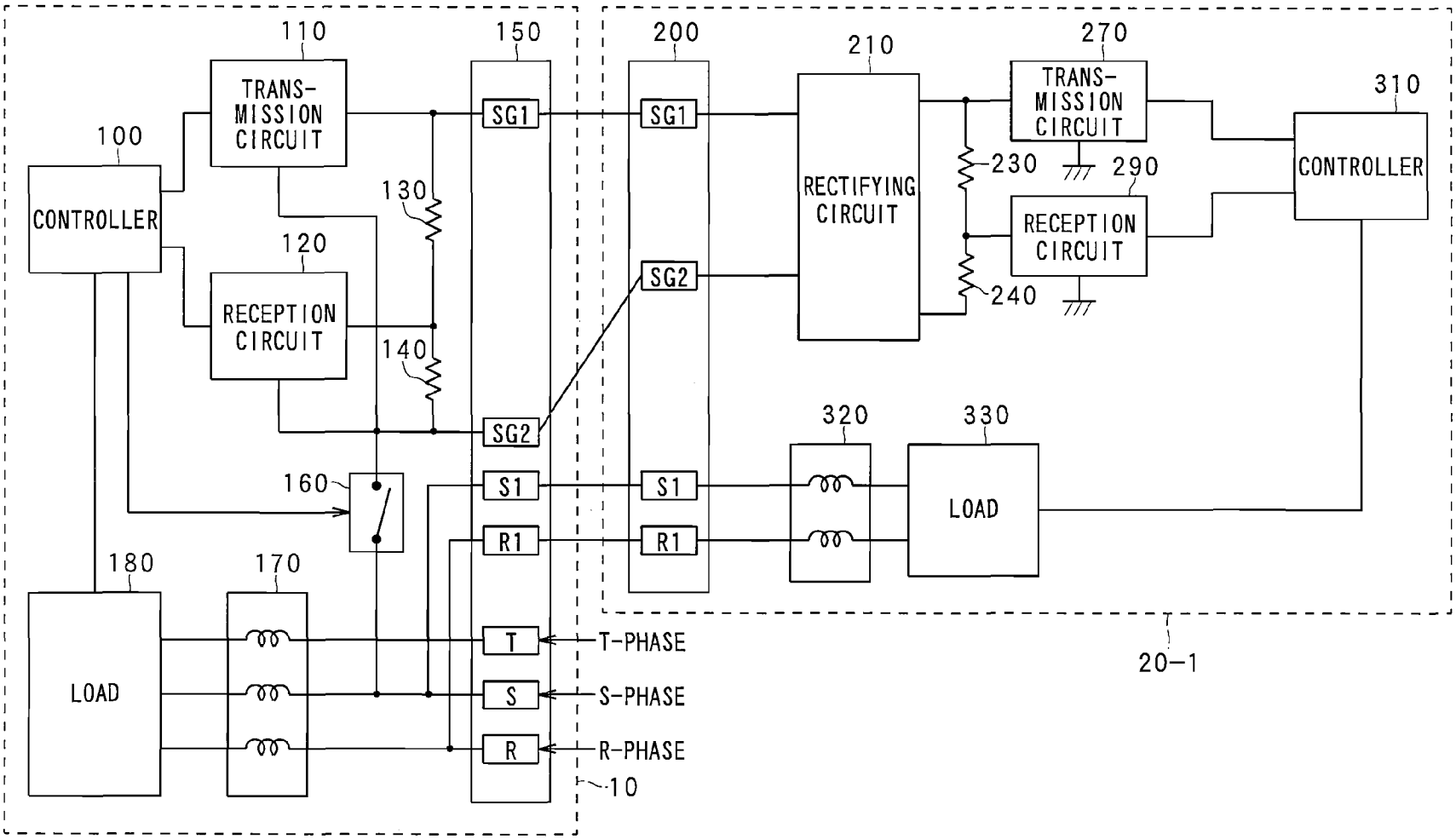
FIG. 2 is a block diagram showing the construction shown in FIG. 1A according to an embodiment of the present invention.

FIG. 2 is a block diagram showing an example of the electrical construction of the outdoor unit 10 and the indoor unit 20-1 shown in FIG. 1A. The indoor units 20-1 to **20-*n* have the same construction, and thus the following description will be made by representatively using the indoor unit 20-1**.

As shown in FIG. 2, the outdoor unit 10 includes a controller 100, a transmission circuit 110 ("third communication circuit" in claims), a reception circuit 120 ("third communication circuit" in claims), resistors 130, 140, a terminal table 150, a switch 160 ("switch" in claims), a noise filter 170 and a load 180.

Here, the controller 100 includes CPU (Central Processing Unit), ROM (Read Only Memory), RAM (Random Access Memory), etc., and it communicates with the indoor units 20-1 to **20-*n* through the transmission circuit 110 and the reception circuit 120 and also controls the load 180, etc. on the basis of the communication result or the like. The transmission circuit 110 generates a serial signal on the basis of data supplied from the controller 100, and transmits the serial signal to the indoor units 20-1 to 20-*n* through the terminal table 150. The reception circuit 120 receives the serial signal transmitted from the indoor units 20-1 to 20-*n*, restores the serial signal to the original data and supplies the original data to the controller 100. The resistors 130, 140 function as input/output resistors for the transmission circuit 110 and the reception circuit 120. The communication lines SG1, SG2, the power supply lines S1, R1 and the three-phase AC power supply lines (the lines corresponding to T-phase, S-phase and R-phase in FIG. 2) are connected to the terminal table 150**.

The switch 160 is constructed by an electromagnetic relay or the like, for example, and when it is set to ON-state, it connects the ground of the transmission circuit 110 and the reception circuit 120 to the S-phase of the power supply. The noise filter 170 is a filter for removing or attenuating noise superposed on the three-phase AC power, and it is constructed by a low pass filter, for example. The load 180 is constructed by a compressor for compressing refrigerant, an air blowing fan, a stepping motor for controlling an outdoor expansion valve, etc., for example.

The indoor unit 20-1 includes a terminal table 200, a rectifying circuit 210, resistors 230, 240, a transmission circuit 270 (corresponding to "first communication circuit" in claims), a reception circuit 290 (corresponding to "first communication circuit" in claims), a controller 310, a noise filter 320 and a load 330. Here, communication lines SG1, SG2 and power supply lines S1, R1 are connected to the terminal table 200. The rectifying circuit 210 rectifies serial signals (signals having a low or high state) transmitted through the communication lines SG1, SG2. Accordingly, the serial signal is nonpolarized, and communication is enabled irrespective of which terminal of the terminal table the communication lines SG1, SG2 are connected to. The resistors 230, 240 function as input/output resistors for the transmission circuit 270 and the reception circuit 290.

The transmission circuit 270 converts data supplied from the controller 310 to a serial signal, and transmits the serial signal through the rectifying circuit 210 and the terminal table 200. The reception circuit 290 receives the serial signal transmitted from the outdoor unit 10, restores the serial signal to the corresponding data and then supplies the data concerned to the controller 310. The controller 310 is constructed by CPU, ROM, RAM, etc., for example, and it communicates with the outdoor unit through the transmission circuit 270 and the reception circuit 290 and also controls the load 330 and the other units on the basis of the communication result, etc.

Figure 3:
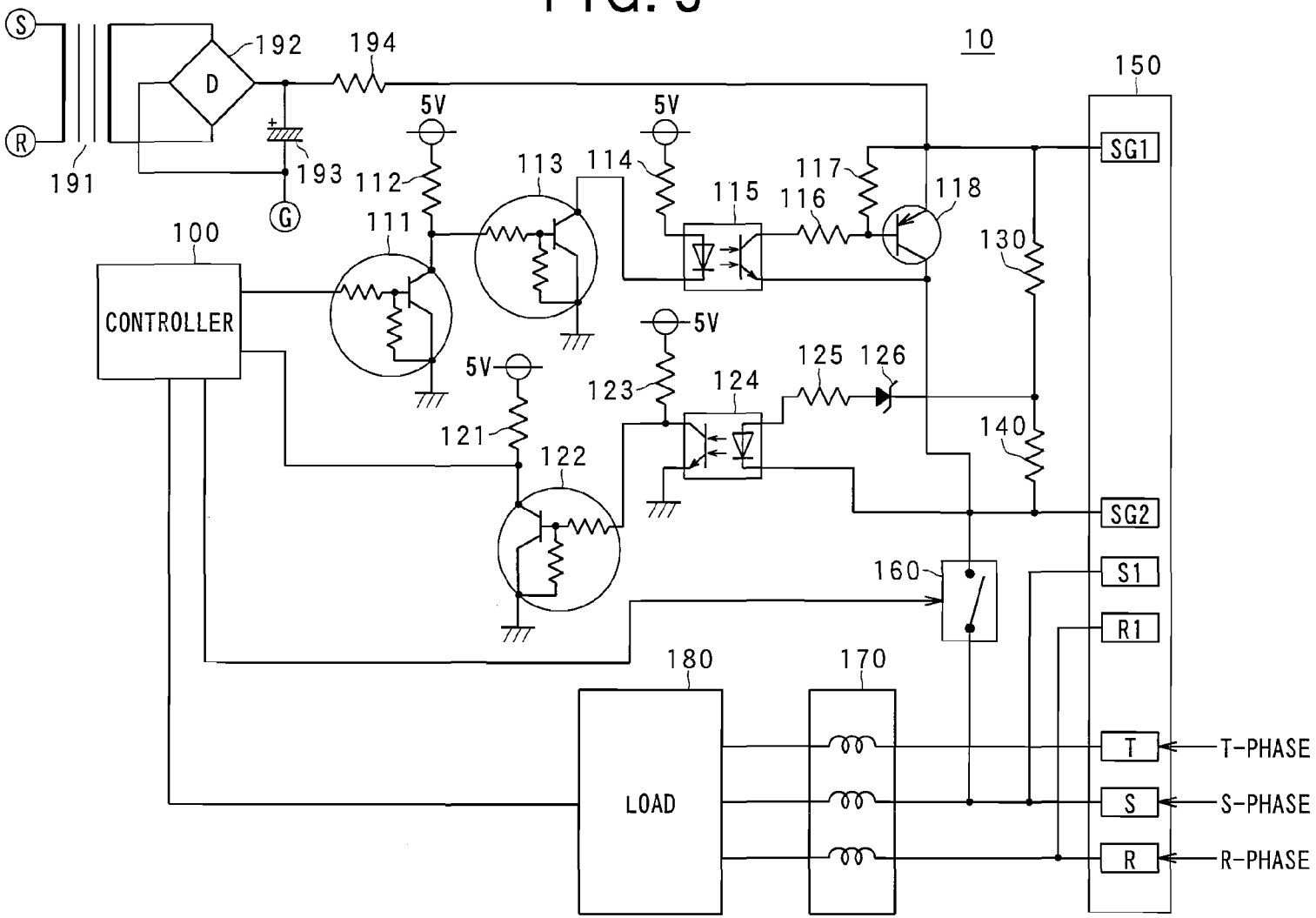
FIG. 3 is a circuit diagram showing the construction of an outdoor unit shown in FIG. 2 according to an embodiment of the present invention.

FIG. 3 is a circuit diagram showing an example of the detailed construction of the outdoor unit 10 shown in FIG. 2. As shown in FIG. 2, the outdoor unit 10 includes a controller 100, transistors 111, 113, 118, 122, resistors 112, 114, 116, 117, 121, 123, 125, 130, 140, photocouplers 115, 124 and a load 180. The emitter of the transistor 118 is supplied with DC power generated by a power supply circuit having a transformer 191, a bridge diode 192, a capacitor 193 and a resistor 194.

Here, the transistors 111, 113, 118, the resistors 112, 114, 116, 117 and the photocoupler 115 constitute the transmission circuit 110. The transistor 122, the resistors 121, 123, 125, the zener diode 126 and the photocoupler 124 constitute the reception circuit 120.

The transistors 111, 113 and the resistor 112 constitute a non-inverting amplifying circuit, and it amplifies data output from the controller 100 and supplies the amplified data to the photocoupler 115. The photocoupler 115 emits light from a built-in LED (Light Emitting Diode) in accordance with current flowing in the collector of the transistor 113, receives the light by a built-in photodiode to convert the intensity of the light to an electrical signal and then outputs the electrical signal. The transistor 118 and the resistors 116, 117 switch the power supply voltage (for example, 24V) supplied from the resistor in accordance with the output of the photocoupler 115, and outputs the voltage to both the ends of the resistors 130, 140.

The zener diode 126 has a function of waveform-shaping the voltage applied across the resistor 140. The resistor 125 limits current flowing to the input side of the photocoupler 124. The photocoupler 124 emits light from a built-in LED in accordance with the voltage output from the resistor 125, converts the light to an electrical signal by a built-in photodiode and then outputs the electrical signal. The resistor 123 limits the current flowing in the photocoupler 124 and the transistor 122. The transistor 122 and the resistor 121 constitutes an inverting amplifying circuit, and it inverts and amplifies the output voltage of the photocoupler 124 and supplies the inverted and amplified output voltage to the controller 100.

When the switch 160 is set to ON-state in accordance with the control of the controller 100, the switch 160 connects the ground side of the transmission circuit 110 and the reception circuit 120 (the collector side of the transistor 118) to the S-phase of the three-phase AC (the input side of the noise filter 170). Each of the T-phase, S-phase and R-phase of the three-phase AC power supplied to the terminal table 150 is supplied to the load 180 through the noise filter 170, and also the S-phase and the R-phase are supplied to the indoor units 20-1 to **20-*n* through the terminal table 150**.

Figure 4:
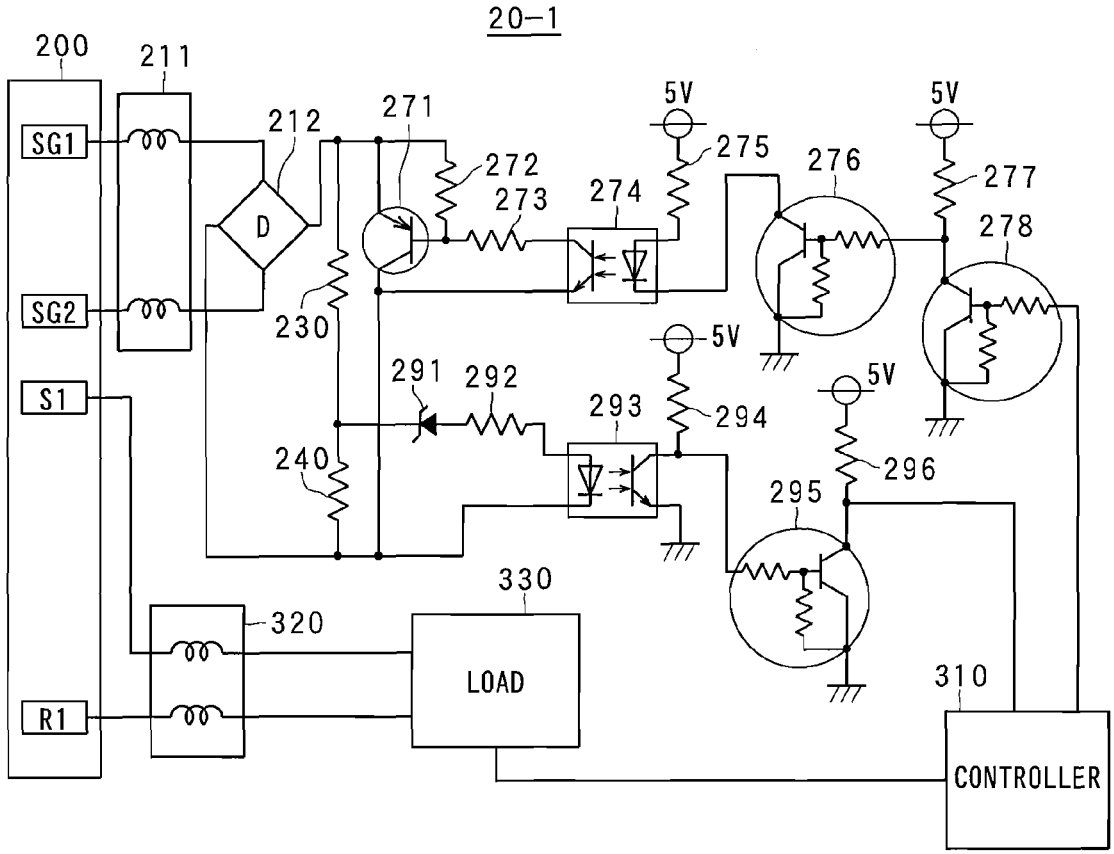
FIG. 4 is a circuit diagram showing the construction of an indoor unit shown in FIG. 2 according to an embodiment of the present invention.

FIG. 4 is a circuit diagram showing an example of the detailed construction of the indoor unit 20-1 shown in FIG. 2. The indoor unit 20-1 includes a terminal 200, noise filters 211, 320, a bridge diode 212, resistors 230, 240, 272, 273, 275, 277, 292, 294, 296, transistors 271, 276, 278, 295, photocouplers 274, 293, a zener diode 291, a controller 310 and a load 330. The noise filter 211 and the bridge diode 212 constitute a rectifying circuit 210. The transistors 271, 276, 278, the resistors 272, 273, 275, 277 and the photocoupler 274 constitute the transmission circuit 270. The transistor 295, the resistors 292, 294, 296, the zener diode 291 and the photocoupler 293 constitute the reception circuit 290.

Here, the transistors 278, 276 and the resistor 277 constitute a non-inverting amplifying circuit, and it inverts and amplifies the signal output from the controller 310 and supplies the inverted and amplified signal to the photocoupler 274. The photocoupler 274 emits light from a built-in LED in accordance with current flowing in the collector of the transistor 276, converts the emitted light to an electrical signal by a built-in photodiode and outputs the electrical signal. The transistor 271 amplifies the output of the photocoupler 274 and outputs the amplified output to the resistors 230, 240.

The zener diode 291 shapes the waveform of the voltage appearing at the resistor 240 and outputs the waveform-shaped voltage. The resistor 292 limits the current flowing to the input terminal of the photocoupler 293. The photocoupler 293 emits light from a built-in LED in accordance with current flowing through the resistor 292, and outputs the voltage corresponding to the intensity of the emitted light by a built-in photodiode. The transistor 295 and the resistor 296 constitute an inverting amplifying circuit, and it inverts the output of the photocoupler 293 and outputs it to the controller 310.

The noise filter 320 is inserted between the terminal table 200 and the load 330, and removes or attenuates high frequency components contained in power supplied from the outdoor unit 10 through the power supply line. The load 330 is constructed by the air blowing fan, the stepping motor for controlling the indoor expansion valve, etc.

Figure 5:
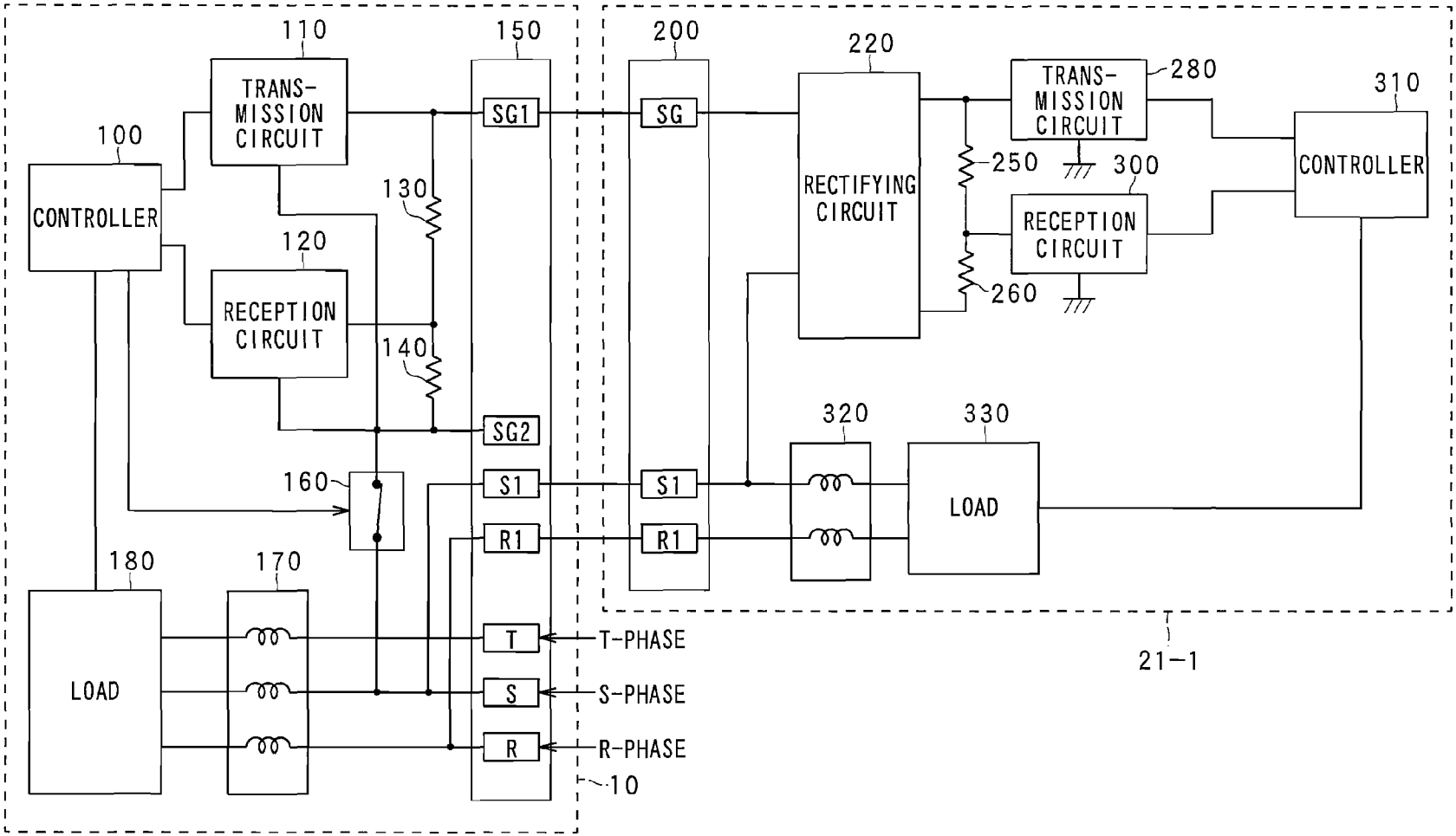
FIG. 5 is a block diagram showing the construction shown in FIG. 1B according to an embodiment of the present invention.

FIG. 5 is a block diagram showing an example of the electrical construction of the outdoor 10 and the indoor unit 21-1 shown in FIG. 1B. The indoor units 21-1 to 21-*n* have the same construction, and thus the description will be made hereunder by using the indoor unit 21-1 representatively. The outdoor unit 10 has the same construction as shown in FIG. 2, and thus the description thereof is omitted.

As shown in FIG. 5, the indoor unit 21-1 includes a terminal table 201, a rectifying circuit 220, resistors 250, 260, a transmission circuit 280 (corresponding to "second communication circuit" in claims), a reception circuit 300 (corresponding to "second communication circuit" in claims), a controller 310, a noise filter 320 and a load 330. The corresponding parts to those of FIG. 2 are represented by the same reference numerals.

Here, a communication line SG1 and power supply lines S1, R1 are connected to the terminal table 201. The rectifying circuit 220 rectifies serial signals transmitted through the communication line SG and the power supply line S1, thereby nonpolarizing the serial signals. The resistors 250, 260 function as input/output resistors for the transmission circuit 280 and the reception circuit 300. The transmission circuit 280 converts data supplied from the controller 310 to a serial signal, and transmits the serial signal through the rectifying circuit 220 and the terminal table 201. The reception circuit 300 receives the serial signal from the outdoor unit 10, restores the serial signal to the corresponding data and then supplies the restored data to the controller 310. The controller 310 is constructed by CPU, ROM, RAM, etc., and it communicates with the outdoor unit 10 through the transmission circuit 280 and the reception circuit 300, and also controls the load 330, etc. on the basis of the communication result or the like.

Figure 6:
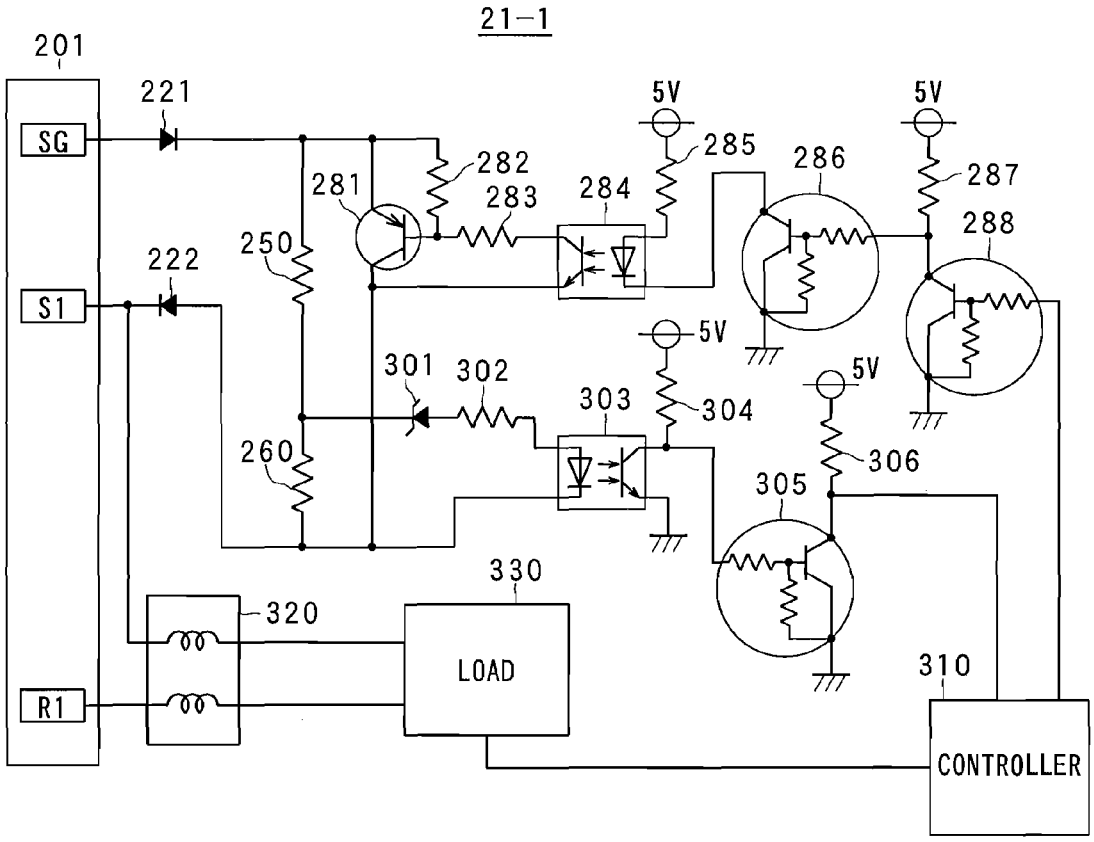
FIG. 6 is a circuit diagram showing the construction of the indoor unit shown in FIG. 5 according to an embodiment of the present invention.

FIG. 6 is a circuit diagram showing an example of the detailed construction of the indoor unit 21-1 shown in FIG. 5. As shown in FIG. 6, the indoor unit 21-1 includes a terminal table 201, diodes 221, 222, resistors 250, 260, 282, 283, 285, 287, 302, 304, 306, transistors 281, 286, 288, 305, photocouplers 284, 303, a zener diode 301, a controller 310, a noise filter 320 and a load 330. The diodes 221, 222 constitute a rectifying circuit 220. The transistors 281, 286, 288, resistors 282, 283, 285, 287 and a photocoupler 284 constitute a transmission circuit 280. The transistor 305, resistors 302, 304, 306, a zener diode 301 and a photocoupler 303 constitute a reception circuit 300.

Here, the transistors 288, 286 and the resistor 287 constitutes a non-inverting amplifying circuit, and it inverts and amplifies the output from the controller 310 and supplies it to the photocoupler 284. The photocoupler 284 emits light from a built-in LED in accordance with current flowing in the collector of the transistor 286, converts the light from the LED to an electrical signal by a built-in photodiode and outputs the electrical signal concerned. The transistor 281 amplifies the output of the photocoupler 284 and outputs the amplified output to the resistors 250, 260.

The zener diode 301 waveform-shapes the voltage appearing at the resistor 260 and outputs the waveform-shaped voltage. The resistor 302 limits current flowing to the input terminal of the photocoupler 303. The photocoupler 303 emits light from a built-in LED in accordance with the current flowing through the resistor 302 and outputs the voltage corresponding to the intensity of the light from a built-in photodiode. The transistor 305 and the resistor 306 constitutes an inverting and amplifying circuit, and it inverts the output of the photocoupler 303 and outputs it to the controller 310.

The noise filter 320 is inserted between the terminal table 201 and the load 330, and removes or attenuates high frequency components contained in the power supplied from the outdoor unit 10 through the power supply line. The load 330 is constructed by the air blowing fan, the stepping motor for controlling the indoor expansion valve, etc.

(B) Operation of First Embodiment

Figure 7:
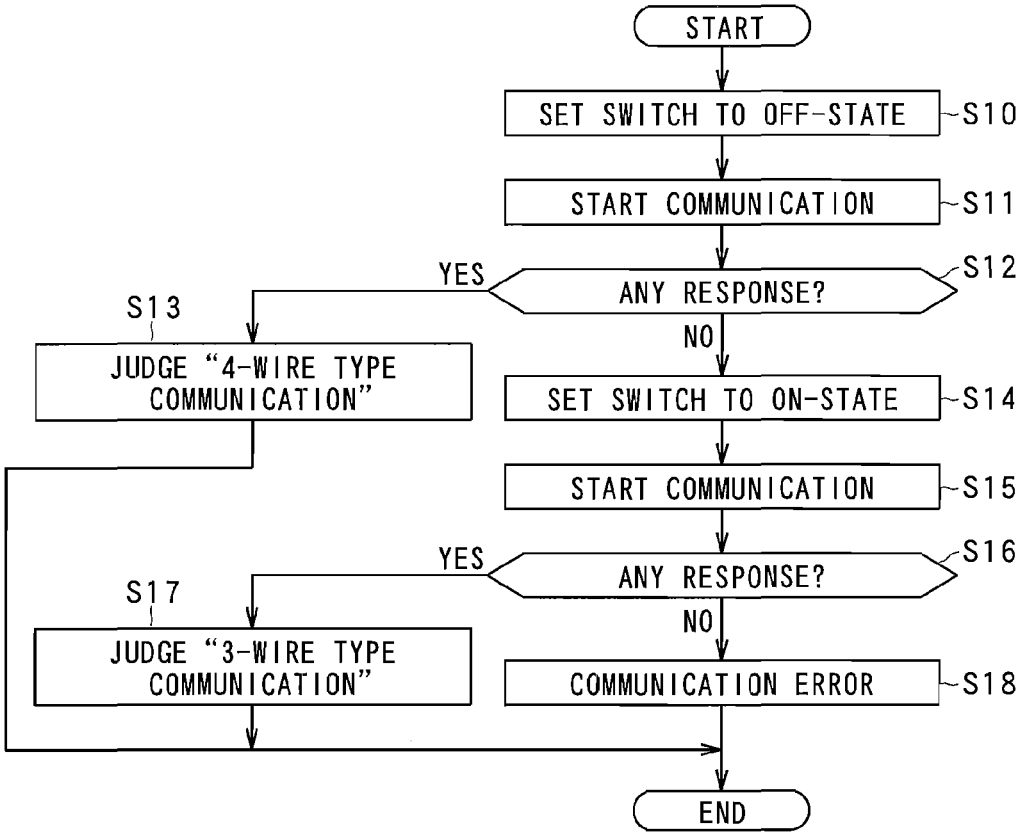
FIG. 7 shows an example of processing executed in the out door unit according to an embodiment of the present invention.

Next, the operation of the first embodiment will be described with reference to FIG. 7. Preferably, the indoor units 20-1 to 20-*n* or indoor units 21-1 to 21-*n* are newly installed together with the outdoor unit 10, the outdoor unit 10 is newly installed under the state that the indoor units 20-1 to 20-*n* or indoor units 21-1 to 21-*n* have been already installed, or the indoor units 20-1 to 20-*n* or the indoor units 21-1 to 21-*n* are newly installed under the state that the outdoor unit 10 has been already installed. When the power of the outdoor unit 10 is turned on after the installation work is finished, the processing shown in FIG. 7 is executed. A program for executing the processing shown in FIG. 7 is stored in ROM (not shown) of the controller 100 of the outdoor unit 10 shown in FIG. 2.

Figure 8A:
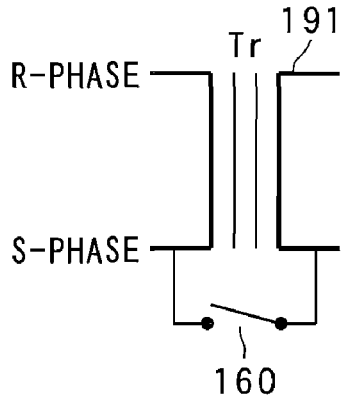
FIGS. 8A, 8B, and 8C are diagrams showing connection relationships between a switch and a transformer.
Figure 8B:
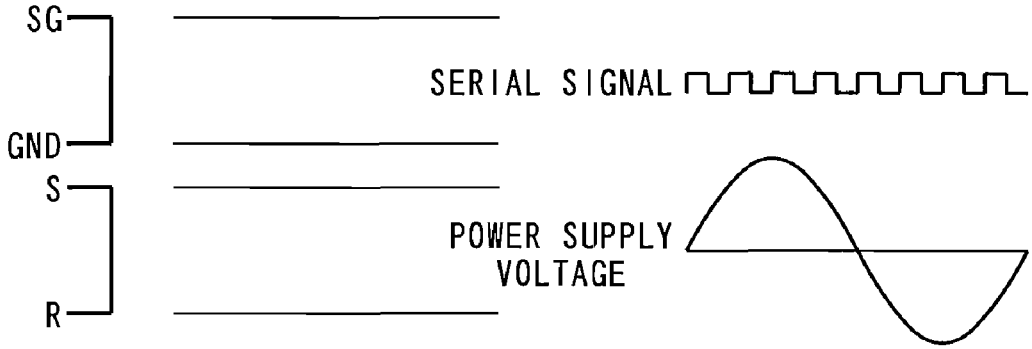
Figure 9A:
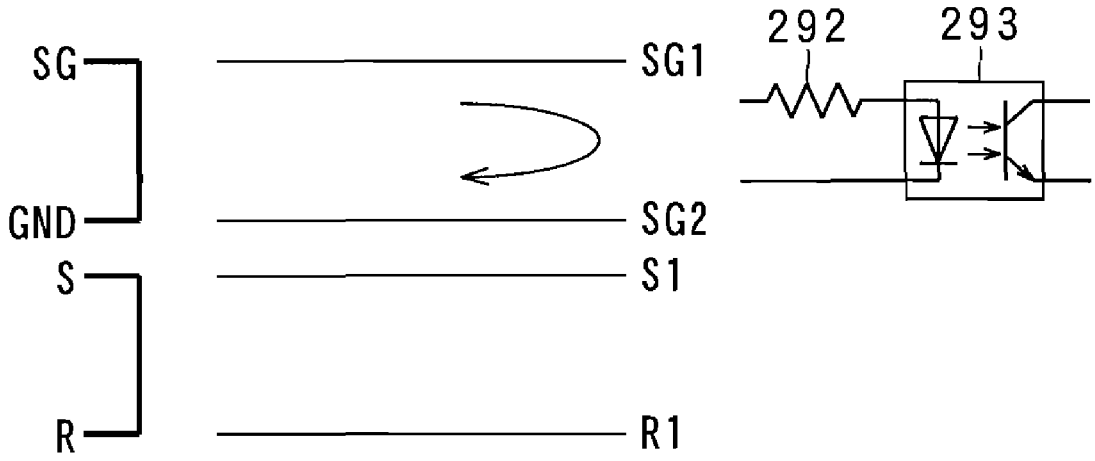
FIGS. 9A and B are diagrams showing connection states between the transformer and a photocoupler.

When the processing shown in FIG. 7 is started, the controller 100 sets the switch 160 to OFF-state (step S10). As a result, the ground of the transmission circuit 110 and the reception circuit 120 are set to be separated from the S-phase of the power source. More specifically, as shown in Fig, 8A, the transformer 191 for supplying power to the transmission circuit 110 and the reception circuit 120 is designed so that the primary side and the secondary side thereof are insulated from each other and they are connected to or disconnected from each other by the switch 160. When the switch 160 is set to OFF-state, the S-phase and the ground GND are separated from each other as shown in FIG. 8B, and thus AC power and the serial signal are separately transmitted as separate signals. As a result, as shown in FIG. 9A, the signal transmitted through the communication lines SG1, SG2 is received by the photocoupler 293.

In step S11, the controller 100 instructs the transmission circuit 110 to start the communication. As a result, the data supplied from the controller 100 are amplified by the transistors 111, 113 constituting the transmission circuit 110, and the amplified data are supplied to the photocoupler 115. The photocoupler 115 emits light from the built-in LED in accordance with the collector current of the transistor 113 and outputs the voltage corresponding to the intensity of the emitted light from the built-in photodiode. The output of the photodiode 115 is supplied to the transistor 118. The power (for example, 24V) from the transformer 191 is supplied to the transistor 118, and the transistor 118 switches the power supply voltage in accordance with the output of the photocoupler 115 and outputs it to the resistors 130, 140.

At this time, when the connection style shown in FIG. 1A is adopted, the signal output from the resistors 130, 140 is supplied through the communication lines SG1, SG2 to the indoor units 20-1 to 20-*n* as shown in FIG. 2. In the indoor unit 20-1 receiving the signal as described above, noise contained in the serial signal is removed by the noise filter 211, and the noise-removed serial signal is amplified by the bridge diode 212 and then applied to the resistors 230, 240. The voltage appearing at the resistor 240 is waveform-shaped by the zener diode 291, and then supplied through the resistor 292 to the photocoupler 293. The photocoupler 293 outputs the voltage corresponding to the voltage supplied through the resistor 292, and supplies the voltage concerned to the transistor 295. The transistor 295 inverts the output voltage of the photocoupler 293 and supplies the inverted output voltage to the controller 310. The controller 310 receiving the communication signal recognizes that the signal from the outdoor unit 10 is received, and an acknowledge signal thereto is output to the transistor 278. The transistors 278, 276 amplify the output of the controller 310 and supplies the amplified output to the photocoupler 274. The voltage corresponding to the collector current of the transistor 276 is output from the photocoupler 274, and supplied to the transistor 271. The transistor 271 outputs the output voltage corresponding to the output of the photocoupler 274 to the resistors 230, 240. The voltage appearing at the resistors 230, 240 is transmitted to the outdoor unit 10 through the communication lines SG1, SG2. The above operation is independently executed in each indoor unit. However, the controller of each indoor unit monitors the state of the communication lines SG1, SG2 by the reception circuit, and it transmits an acknowledge signal after it is checked that no signal is transmitted on the communication lines SG1, SG2. Accordingly, signal collision on the communication lines SG1, SG2 can be avoided.

The signal transmitted from the indoor unit 20-1 is transmitted through the communication lines SG1, SG2 to the outdoor unit 10. In the outdoor unit 10, the voltage supplied from the communication lines SG1, SG2 appears at the resistors 130, 140. The voltage (reception signal) appearing at the resistor 140 is waveform-shaped by the zener diode 126, and then supplied to the photocoupler 124 through the resistor 125. The output corresponding to the voltage appearing at the resistor 140 occurs at the output side of the photocoupler 124, and the transistor 122 inverts and amplifies the output voltage and supplies it to the controller 100. The controller 100 receives the output voltage of the transistor 122, and returns it to the original data, thereby recognizing that there is an acknowledge from the indoor unit 20-1.

Alternatively, when the connection style shown in FIG. 1B is adopted in the communication style described above, the switch 160 is set to OFF-state in FIG. 5. In this case, the ground side of the transmission circuit 110 and the reception circuit 120 are set to Open-state, so that the outdoor unit 10 is set not to be connected to the indoor units 21-1 to **21-*n* through the communication lines. Therefore, the outdoor unit cannot communicate with the indoor units 21-1 to 21-*n*. Accordingly, in such a case, even when the outdoor unit 10 starts the communication, no response (acknowledge) is transmitted from the indoor units 21-1 to 21-*n***.

As described above, when the communication is started in step S11, an acknowledge is transmitted from the indoor units 20-1 to **20-*n* if the connection style of FIG. 1A is adopted. Alternatively, if the connection style of FIG. 1B is adopted, no acknowledge is transmitted from the indoor units 21-1 to 21-*n*. Accordingly, in step S12, when the connection style of FIG. 1A is adopted, it is judged that there is an acknowledge (step S12; Yes), and the processing goes to step S13. When the connection style of FIG. 1B is adopted, it is judged that there is no acknowledge (step S12; No), and the processing goes to step S14**.

In step S13, the controller 100 judges that the 4-wire type communication is adopted, and it keeps the switch 160 to OFF-state and finishes the processing. That is, the controller 100 judges that the connection style shown in FIG. 1A is adopted, and keeps the switch 160 to OFF-state.

Figure 8C:
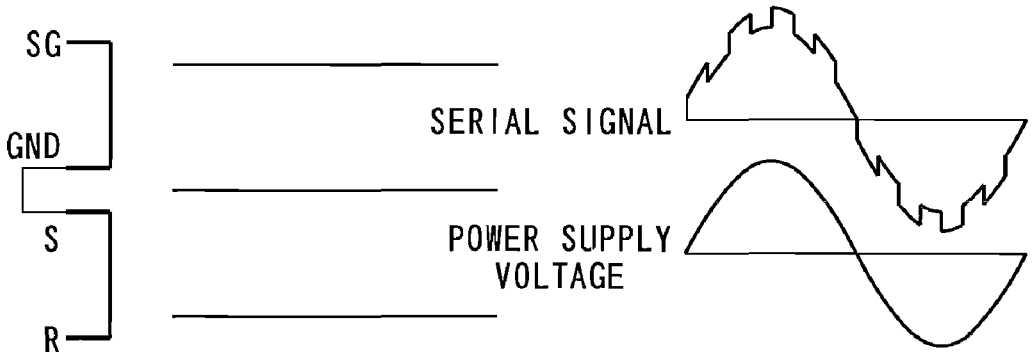
Figure 9B:
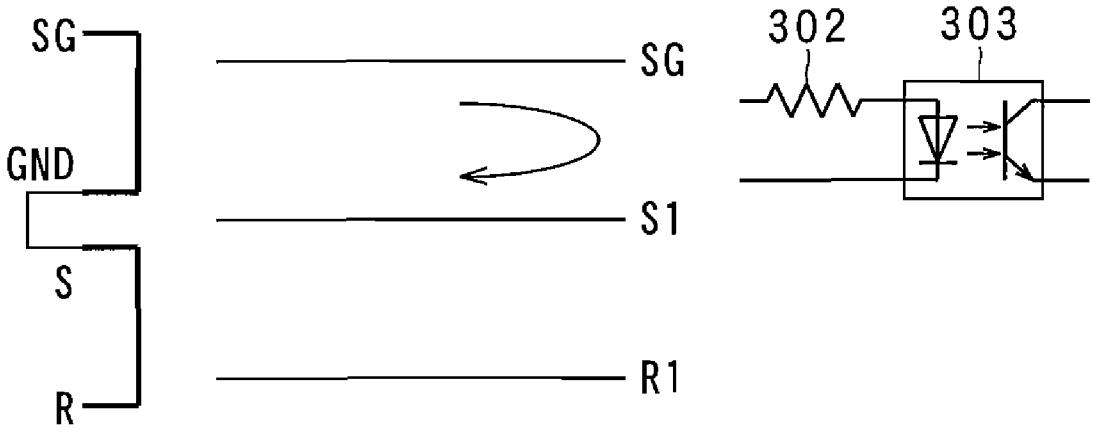

Alternatively, if No is judged in step S12, the processing goes to step S14, and the controller 100 sets the switch 150 to ON-state. As a result, the ground of the transmission circuit 110 and the reception circuit 120 and the S-phase of the power supply are set to be connected to each other. More specifically, as shown in FIG. 8B, when the switch 160 is set to ON-state, the S-phase and the ground (GND) are set to be connected to each other, and thus AC power and the serial signal are superposed and output as shown in FIG. 8C. As a result, as shown in FIG. 9B, the signal transmitted through the communication line SG and the power supply line S1 is received by the photocoupler 303.

In step S15, the controller 100 instructs the transmission circuit 110 to start the communication. As a result, the data supplied from the controller 100 are amplified by the transistors 111, 113 constituting the transmission circuit 110, and supplied to the photocoupler 115. The photocoupler 115 emits light from the built-in LED in accordance with the collector current of the transistor 113 and outputs the voltage corresponding to the intensity of the light from the built-in photodiode. The output of the photocoupler 115 is supplied to the transistor 118. The power from the transformer 191 is supplied to the transistor 118, and the transistor 118 switches the power source voltage in accordance with the output of the photocoupler 115 and outputs it to the resistors 130, 140.

At this time, when the connection style of FIG. 1B is adopted, as shown in FIG. 5, the signal output from the resistors 130, 140 is supplied to the indoor unit 21-1 to **21-*n* through the communication line SG and the power supply line S1. In the indoor unit 21-1 receiving such a signal, the reception signal is rectified by the diodes 221, 222, and the obtained signal is applied to the resistors 250, 260. The voltage appearing at the resistor 260 is waveform-shaped by the zener diode 301, and then supplied through the resistor 302 to the photocoupler 303. The photocoupler 303 outputs the voltage corresponding to the voltage supplied through the resistor 302, and supplies it to the transistor 305. The transistor 305 inverts and amplifies the output voltage of the photocoupler 303, and supplies it to the controller 310. The controller 310 received the serial signal recognizes that the signal from the outdoor unit 10 is received, and outputs an acknowledge signal thereto to the transistor 288. The transistors 288, 286 amplify the output of the controller 310, and supply it to the photocoupler 284. The voltage corresponding to the collector current of the transistor 286 is output from the photocoupler 284, and supplied to the transistor 281. The transistor 281 outputs the output voltage corresponding to the output of the photocoupler 284 to the resistors 250, 260. The voltage appearing at the resistors 250, 260 is transmitted through the communication line SG and the power supply line Si to the outdoor unit 10. The above operation is executed independently in each indoor unit. However, the controller of each indoor unit monitors the state of the communication line SG and the power supply line S1 by the reception circuit, and transmits an acknowledge after it is checked that no signal is transmitted onto the communication line SG and the power supply line S1. Accordingly, signal collision on the communication line SG and the power supply line S1** is avoided.

The signal transmitted from the indoor unit 21-1 is transmitted to the outdoor unit 10 through the communication line SG and the power supply line S1. In the outdoor unit 10, the voltage supplied from the communication line SG and the power supply line S1 appear at the resistors 130, 140. The voltage appearing at the resistor 140 (the reception signal) is waveform-shaped by the zener diode 126, and then supplied to the photocoupler 124 through the resistor 125. The output corresponding to the voltage appearing at the resistor 140 occurs at the output side of the photocoupler 124, and the transistor 122 inverts and amplifies this output voltage and supplies it to the controller 100. The controller 100 receives the output voltage of the transistor 122, and restores it to the original data, thereby recognizing that there is an acknowledge from the indoor unit 21-1.

Alternatively, when the connection style of FIG. 1A is adopted, it is judged in step S12 that there is an acknowledge, and thus the processing of the step S14 and subsequent steps are not executed.

In step S16, if there is an acknowledge from the indoor unit (step S16; Yes), the processing goes to step S17. If there is no acknowledge (step S16; No), the processing goes to step S18. For example, when the connection style of FIG. 1B is adopted, an acknowledge is transmitted from the indoor unit, and thus the processing goes to step S17.

In step S17, the controller 100 judges that the 3-wire type communication is adopted, and keeps the switch 160 to ON-state. Accordingly, the outdoor unit 10 and the indoor units 21-1 to **21-*n*** are kept to a communication-possible state.

In step S18, the controller 100 judges a communication error because the communication is impossible by neither the 4-wire type communication nor the 3-wire type communication and thus wiring miss is assumed, for example, and thus the controller 100 finishes the processing. When a communication error occurs, LED (not shown) or the like is turned on to notify this fact to the installation technician.

As described above, according to the first embodiment of the present invention, even when an indoor unit adopting any one of the communication systems shown in FIGS. 2 and 5 is connected to the outdoor unit 10, the outdoor unit 10 can automatically identify the communication system of the indoor unit, and set the switch 160 to ON-state or OFF-state on the basis of the identification result. Accordingly, the outdoor unit can be replaced or added irrespective of the type of the exiting indoor units. Therefore, the choice of the machine type is increased. The installation technician can shorten the time required for the setting because the outdoor unit 10 automatically selects the proper communication system insofar as wiring is accurately performed. Furthermore, even when communication cannot be performed by using any communication system, occurrence of a communication error is notified to the installation technician. Therefore, the installation technician can rapidly know that the communication cannot be performed due to faulty wiring.

Furthermore, in the first embodiment of the present invention, the ground of the transmission circuit 110 and the ground of the reception circuit 120 are connected to the power supply line, so that the transmission and reception operation can be stably performed. The switch 160 is provided at the front stage of the noise filter 170, so that the serial signal can be prevented from being attenuated by the noise filter 170. Accordingly, stable communication can be performed.

Furthermore, in the first embodiment of the present invention, in the processing shown in FIG. 7, the switch 160 is first set to OFF-state to detect the communication system. When the communication system is detected under the state that the switch 160 is set to ON-state, there is a case where communication is possible even when the outdoor unit and the indoor units are connected by the 4-wire type communication. Therefore, there is a case where the switch 150 is erroneously set to ON-state. That is, in the case of the 4-wire type, the communication lines SG1, SG2 are connected to the indoor units 20-1 to **20-*n* irrespective of the state of the switch 160, and thus communication may be possible. Alternatively, when the switch 160** is set to OFF-state, in the case of the 3-wire type communication, communication is impossible because one of the communication lines is not connected. Therefore, in the first embodiment of the present invention, the detection is first performed under the state that the switch is set to OFF-state, so that the erroneous detection as described above can be prevented.

(C) Construction of Second Embodiment

Next, a second embodiment of the present invention will be described.

Figure 10:
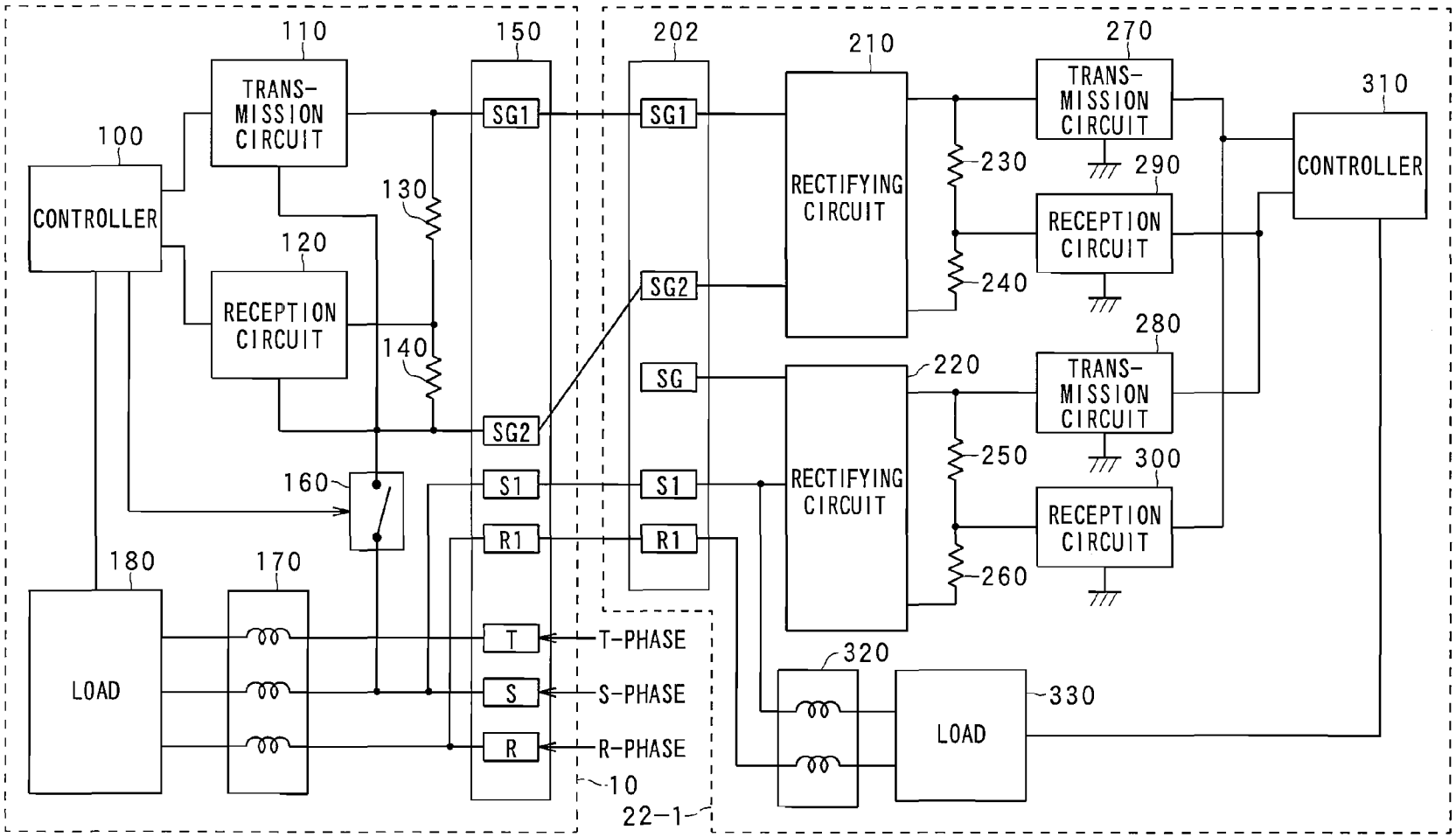
FIG. 10 shows the construction of the air conditioning system according to another embodiment of the present invention.
Figure 11:
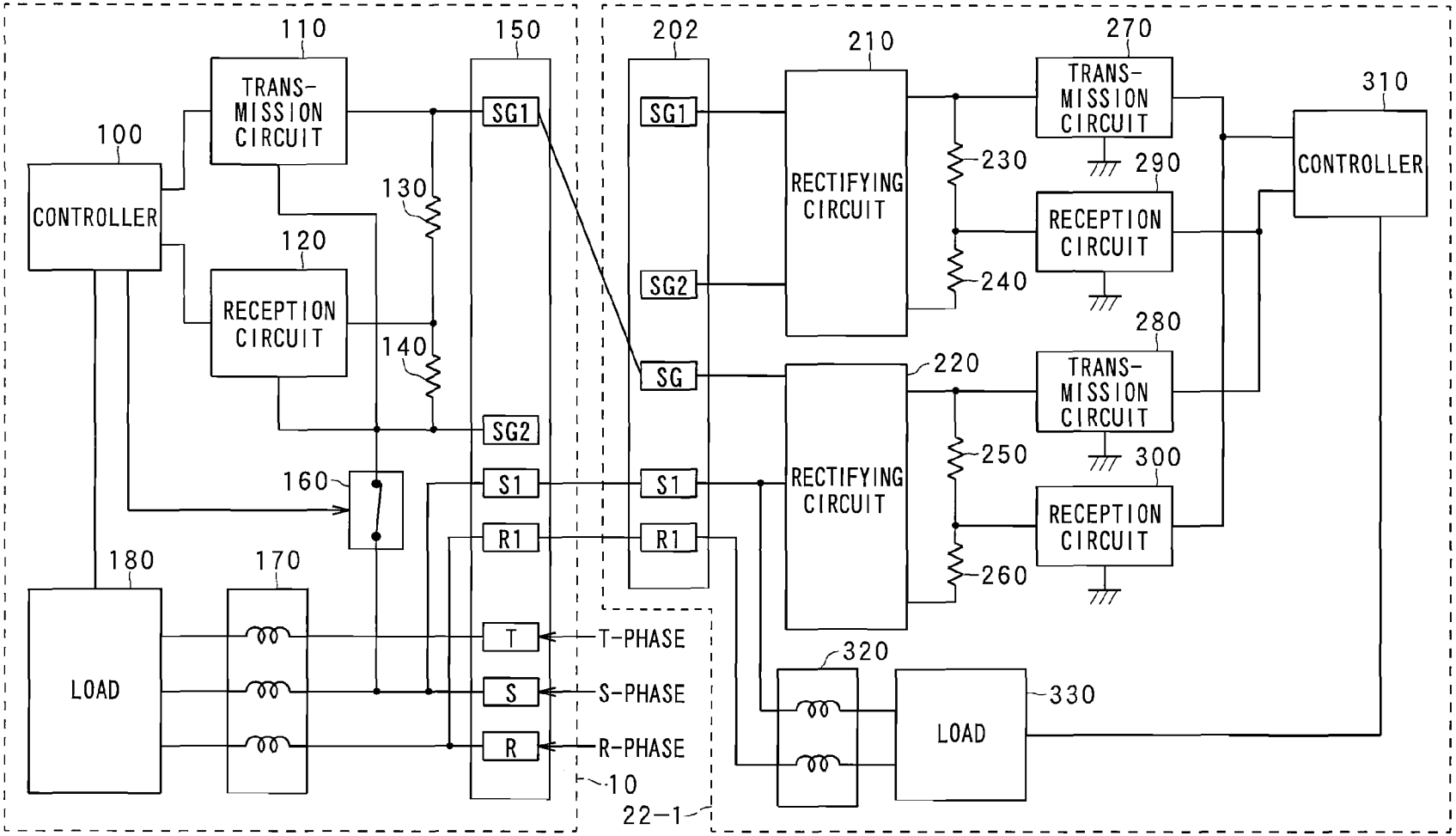
FIG. 11 is a diagram showing the construction of an air conditioning system according to the an embodiment of the present invention.

FIGS. 10 and 11 are block diagrams showing the construction of the second embodiment of the present invention. The second embodiment is different from the first embodiment in the construction of the indoor unit. The other construction of the second embodiment is the same as the first embodiment. As shown in FIGS. 10 and 11, the indoor unit 22-1 of the second embodiment has both of the 4-wire type communication circuit (the transmission circuit 270, the reception circuit 290, etc.) and the 3-wire type communication circuit (the transmission circuit 280, the reception circuit 300, etc.), and any communication system can be selected in accordance with the method for the wiring between the outdoor unit and the indoor unit. That is, any one of the 4-wire type and the 3-wire type can be selected by selecting any one of the wiring style shown in FIG. 1A or the wiring style shown in FIG. 1B.

As shown in FIGS. 10 and 11, the indoor unit 22-1 includes a terminal table 202, rectifying circuits 210, 220, resistors 230 to 260, transmission circuits 270, 280, reception circuits 290, 300, a controller 310, a noise filter 320 and a load 330. The corresponding parts to those of FIGS. 2 and 5 are represented by the same reference numerals, and thus the detailed description of the respective constituent elements is omitted.

In FIG. 10, SG1 of the terminal table 150 and SG1 of the terminal table 202 are connected to each other, and SG2 of the terminal table 150 and SG2 of the terminal table 202 are connected to each other, whereby the 4-wire type communication is selected. In FIG. 11, SG1 of the terminal table and SG of the terminal table 202 are connected to each other, and SG2 of the terminal table 150 is set to an open state.

Figure 12:
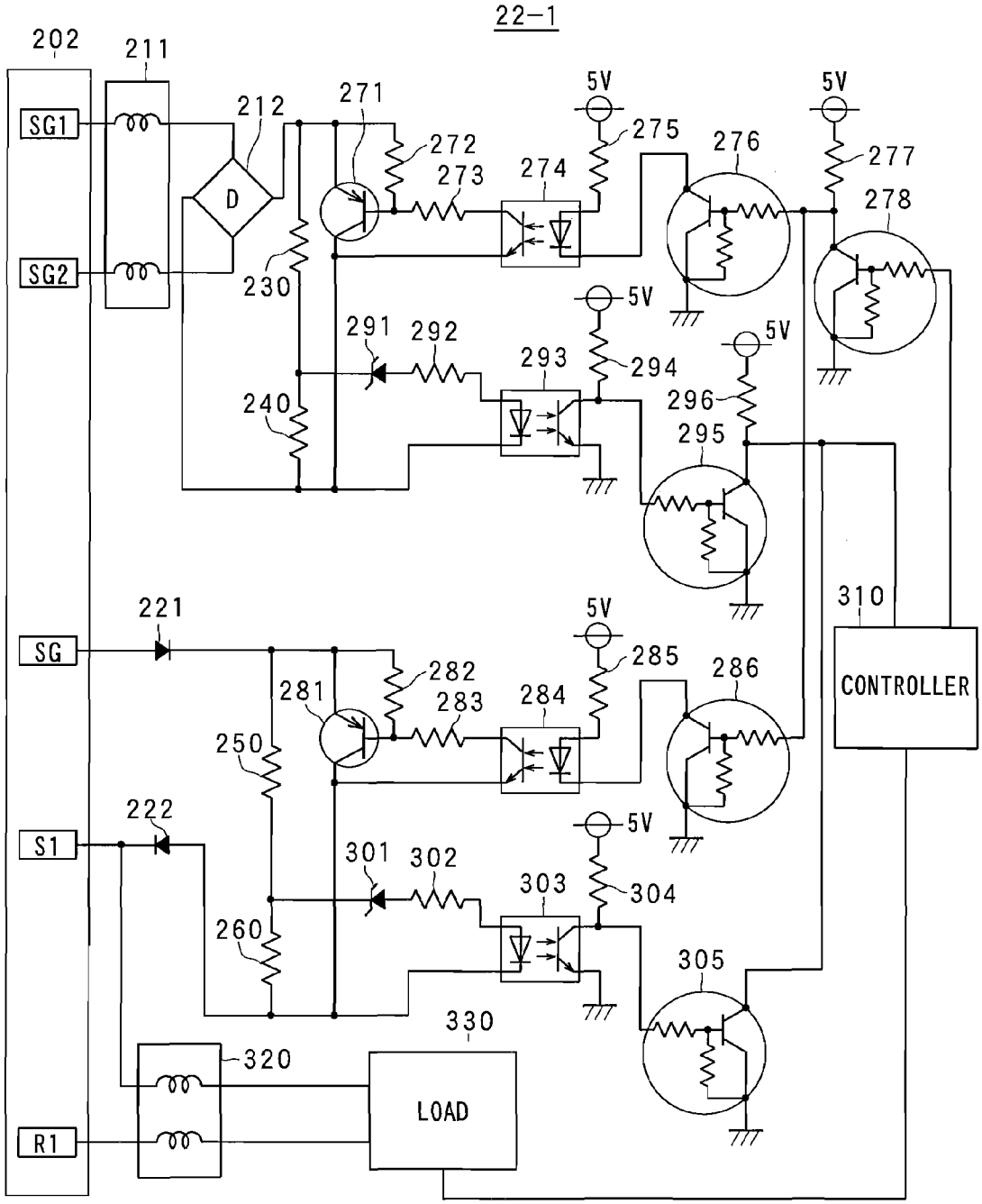
FIG. 12 is a circuit diagram showing the construction of the indoor unit shown in FIGS. 10 and 11 according to an embodiment of the present invention.

FIG. 12 is a circuit diagram showing the detailed construction of the indoor unit 22-1 shown in FIGS. 10 and 11. In FIGS. 10 and 11, the corresponding parts to those of FIGS. 4 and 6 are represented by the same reference numerals, and the detailed description thereof is omitted. In the example shown in FIG. 12, as compared with the circuit construction of FIG. 6, the transistor 288 shown in FIG. 6 and the resistor 287 are omitted, and the transistor 278 and the resistor 277 are commonly used. Furthermore, the resistor 306 shown in FIG. 6 is omitted, and the resistor 296 is commonly used. In the example of FIG. 12, the terminal table 202 is newly provided in place of the terminal tables 200, 201. With respect to the terminal table 202, the communication lines SG1, SG2 and SG are connectable, and the power supply lines S1, R1 are connectable. The other construction is the same as those of FIGS. 4 and 6.

(D) Operation of Second Embodiment

Next, the operation of the second embodiment of the present invention will be described. The following description will be made by applying a case where an outdoor unit and an indoor unit are additionally provided under the state that an indoor unit and wiring exist or a case where an outdoor unit and an indoor unit are additionally provided under the state that wiring exists. More specifically, for example, an outdoor unit and an indoor unit are additionally provided under the state that the wiring shown in FIG. 1A or FIG. 1B has already existed, or an outdoor unit and an indoor unit are additionally provided under the state that the wiring and the indoor units shown in FIG. 1A or FIG. 1B have already existed.

For example, when an indoor unit and an outdoor unit are installed under the state that the wiring shown in FIG. 1A has already existed or the wiring and the indoor units shown in FIG. 1A have already existed, the installation technician connects the outdoor unit 10 and the indoor unit 22-1 by the wiring method shown in FIG. 10. That is, SG1, SG2 of the terminal table 150 are connected to SG1, SG2 of the terminal table 202, and also S1, R1 of the terminal table 150 are connected to S1, R1 of the terminal table 202.

Alternatively, when an indoor unit and an outdoor unit are installed under the state that the wiring and the indoor units shown in FIG. 1B have already existed, the installation technician connects the outdoor unit 10 and the indoor unit 22-1 by the wiring shown in FIG. 11. That is, SG1 of the terminal table 150 is connected to SG of the terminal table 202, and S1, R1 of the terminal table 150 are connected to S1, R1 of the terminal table 202.

When the wiring work and the installation work are completed, the installation technician turns on the power of the outdoor unit 10. As a result, the power supply to the respective parts of the outdoor unit 10 is started, and also the power supply to the respective indoor units is started through the power supply lines S1, R1. Subsequently, the controller 100 of the outdoor unit 10 executes the processing shown in FIG. 7.

As a result when the connection style shown in FIG. 10 is adopted, the communication is executed between the transmission circuit 270 and the reception circuit 290 in step S11, and thus "Yes" is judged in step S12. Accordingly, the processing goes to step S13 to fix the switch 160 to OFF-state and select the 4-wire type communication. Furthermore, when the connection style shown in FIG. 11 is adopted, the communication is executed between the transmission circuit 280 and the reception circuit 200 in step S15, and thus "Yes" is judged in step S16. Therefore, the processing goes to step S17 to fix the switch 160 to ON-state and select the 3-wire type communication. As a result, the communication can be normally executed between the indoor units and the outdoor unit irrespective of the state of the existing facilities.

As described above, in the second embodiment of the preset invention, both the 4-wire type communication circuit and the 3-wire type communication circuit are provided for the indoor units. Therefore, anew indoor unit can be additionally provided or replaced irrespective of whether the existing facilities adopt the 4-wire type communication or the 3-wire type communication.

Furthermore, the outdoor unit 10 automatically recognizes which one of the 4-wire type and the 3-wire type is selected, and sets the switch 160 to ON-state or OFF-state on the basis of the recognition result through the above processing, whereby the load of the installation technician can be reduced.

Furthermore, in the second embodiment of the present invention, the switch 160 is first set to OFF-state and the communication style is detected by the processing shown in FIG. 7. Therefore, error detection can be prevented as described above.

(E) Modifications

The present invention is not limited to the above-described embodiments, and various modifications and applications may be made without departing from the subject matter of the present invention. For example, the circuit constructions shown in FIGS. 3, 4, 6, 12 are examples, and other circuit constructions may be adopted.

In the above-described embodiments, the switch 160 is the electromagnetic relay. However, a semiconductor switch or the like may be used. Furthermore, in the above-described embodiments, the switch 160 is connected to the S-phase. However, the switch 160 may be connected to the other phases (for example, R-phase). Still furthermore, the noise filter 170 may be omitted.

In the above-described embodiments, the switch 160 is automatically set. For example, the switch 160 may be a manual switch so that the installation technician can manually set the switch 160. For example, when the 3-wire type is selected, the manual switch is set to ON-state, and when the 4-wire type is selected, the manual switch is set to Off-state. By using this method, new equipment can be also additionally provided or replaced and normal communication can be performed irrespective of the state of the existing facilities.

In the above-described embodiments, the air conditioning system is constructed by the outdoor unit 10 and the indoor units 20-1 to **20-*n*, the indoor units 21-1 to 21-*n* or the indoor units 22-1 to 22-*n***. However, in addition to these constructions, a central control unit and an interface device may be added as occasion demands. Furthermore, the number of indoor units may be one or more.

In the second embodiment, the outdoor unit 10 is provided with the function of automatically detecting the communication system by the switch 160. However, the indoor unit 22-1 shown in FIGS. 10, 11 may be connected to an outdoor unit which does not have the above function. In this case, in the case of the 4-wire type outdoor unit, the wiring method shown in FIG. 10 may be adopted. In the case of the 3-wire type outdoor unit, the wiring method shown in FIG. 11 may be adopted. According to this embodiment, an indoor unit can be additionally provided or replaced irrespective of the type of the existing outdoor unit.

While the invention has been described in connection with various embodiments, the invention is not limited to the described embodiments but rather is more broadly defined as recited in the claims below and equivalents thereof.

I claim:

1. An air conditioning system comprising:

a first communication line;

a second communication line; and an indoor unit coupled to an outdoor unit via at least one common power supply line, the indoor unit having at least one of a first communication circuit and a second communication circuit, the first communication circuit configured to communicate through the first communication line and the second communication line independent of the at least one common power supply line, and the second communication circuit configured to communicate through the at least one common power supply line and one of the first communication line and the second communication line, and the outdoor unit having a third communication circuit having a plurality of communication terminals coupled to the indoor unit and configured to communicate with at least one of the first communication circuit and the second communication circuit, and a switch configured to connect one of the plurality of communication terminals of the third communication circuit to the at least one common power supply line when the third communication circuit is connected to the second communication circuit and further configured to open a connection between the communication terminal of the third communication circuit and the at least one common power supply line when the third communication circuit is connected to the first communication circuit.

2. The air conditioning system according to claim 1, wherein the indoor unit includes the first communication circuit and the second communication circuit, and wherein the switch of the outdoor unit is configured to be switched based on whether the outdoor unit is connected to the first communication circuit or the second communication circuit.

3. The air conditioning system according to claim 1, wherein one of the plurality of communication terminals of the third communication circuit is coupled to a ground of the third communication circuit, and the switch is further configured to connect the one of the plurality of communication terminals connected to the ground of the third communication circuit to one of the common power supply lines.

4. The air conditioning system according to claim 3, wherein the outdoor unit further comprises:

a first noise filter, having an input, disposed between a first load and the common power supply lines, the switch is further configured to connect one of the common power supply lines at the input of the first noise filter to the one of the plurality of communication terminals connected to the ground of the third communication circuit, and the indoor unit further comprises a second noise filter, having an input, disposed between a second load and the common power supply lines, and the second communication circuit is connected to one of the common power supply lines at the input side of the second noise filter.

5. An outdoor-unit that is connectable through at least one common power supply line to an indoor unit, comprising:

at least one of a first communication circuit and a second communication circuit, the first communication circuit configured to communicate through a first and a second communication line independent of the at least one common power supply line, and the second communication circuit configured to communicate through the at least one common power supply line and the first communication line;

a third communication circuit having a plurality of communication terminals and configured to communicate with one of the first communication circuit and the second communication circuit in a state where the outdoor unit is coupled to the indoor unit; and a switch configured to connect one of the plurality of connection terminals of the third communication circuit to the at least one common power supply line when the third communication circuit is connected to the second communication circuit, and further configured to open a connection between one of the plurality of communication terminals of the third communication circuit and the at least one common power supply line when the third communication circuit is connected to the first communication circuit.

* * * * *